US009735492B2

(12) United States Patent
Shum et al.

(10) Patent No.: US 9,735,492 B2
(45) Date of Patent: Aug. 15, 2017

(54) ADJUSTABLE ROTARY SOCKET ASSEMBLY

(71) Applicant: Baccus Global LLC, Boca Raton, FL (US)

(72) Inventors: Henry Shum, Hong Kong (CN); Mathew Inskeep, Boca Raton, FL (US)

( * ) Notice: Subject to any disclaimer, the term of this patent is extended or adjusted under 35 U.S.C. 154(b) by 115 days.

(21) Appl. No.: 13/663,264

(22) Filed: Oct. 29, 2012

(65) Prior Publication Data

US 2014/0120740 A1 May 1, 2014

(51) Int. Cl.

| | |
|---|---|
| ***H01R 35/04*** | (2006.01) |
| ***H01R 13/453*** | (2006.01) |
| ***H01R 24/78*** | (2011.01) |
| ***H01R 25/00*** | (2006.01) |

(52) U.S. Cl.

CPC ..... *H01R 13/4532* (2013.01); *H01R 24/78* (2013.01); *H01R 25/00* (2013.01); *H01R 35/04* (2013.01)

(58) Field of Classification Search

CPC ..... H01R 13/4532; H01R 35/04
USPC ..... 439/13, 131, 640, 22, 224, 21
See application file for complete search history.

(56) References Cited

U.S. PATENT DOCUMENTS

| | | | | |
|---|---|---|---|---|
| 2,477,901 | A * | 8/1949 | Robboy | 174/86 |
| 5,551,882 | A | 9/1996 | Whiteman, Jr. et al. | |
| 6,157,350 | A * | 12/2000 | House et al. | 343/906 |
| 6,642,450 | B1 | 11/2003 | Hsiao | |
| 6,913,467 | B2 | 7/2005 | Huang | |
| 7,214,102 | B2 | 5/2007 | Chong | |
| 7,264,514 | B2 | 9/2007 | Hsu et al. | |
| 7,275,942 | B1 | 10/2007 | Wu | |
| 7,374,425 | B1 | 5/2008 | Kuo et al. | |
| 7,393,250 | B2 | 7/2008 | Tanaka | |
| 7,771,239 | B1 | 8/2010 | Hsiao | |
| 7,950,934 | B2 * | 5/2011 | Sallam et al. | 439/135 |
| 7,972,152 | B1 | 7/2011 | Wu | |
| 8,157,574 | B2 | 4/2012 | Hsiao | |
| 2003/0134537 | A1 | 7/2003 | Pedulla et al. | |
| 2006/0094285 | A1 * | 5/2006 | Newell | 439/446 |
| 2012/0028505 | A1 | 2/2012 | Weber et al. | |
| 2012/0108101 | A1 | 5/2012 | Hu | |

* cited by examiner

*Primary Examiner* — Renee Luebke
*Assistant Examiner* — Paul Baillargeon

(57) ABSTRACT

An electrical outlet includes an outlet housing having an outer support arm and an inner support arm, the outer and inner support arms defining a socket receptacle; the inner and outer support arms having a rotational support member and a fixed electrical contact assembly; a rotary socket having at least one plug receiver for receiving an electrical plug and a rotary contact plate attached thereto; wherein the rotary contact plate is rotationally supported by the rotational support member, and the rotary contact plate maintains electrical contact with the fixed electrical contact assembly through a predetermined range of rotation of the rotary socket. Rotation control functions of the rotary contact plate to limit the range of rotation and provide adjustable angles of rotation are also described.

13 Claims, 4 Drawing Sheets

ADJUSTABLE ROTARY SOCKET ASSEMBLY

TECHNICAL FIELD

The present invention relates generally to an electrical outlet, and, particularly, to an electrical outlet with adjustable rotary sockets.

BACKGROUND

Electrical outlets having multiple sockets are well known to one of ordinary skill in the art. The use and need for multiple sockets has increased with increased usage of electrical equipment. For example, in the home and office, multiple socket electrical outlets are widely used to power multiple pieces of computer equipment, audio/visual equipment, kitchen equipment, and the wide variety of consumer electronics. These electrical outlets are commonly referred to as surge protectors or electrical strips.

Similarly, as the use of mobile devices has proliferated so has the need for mobile electrical power. The wide variety of consumer electronics includes cellular telephones, laptop computers, e-readers, tablets, portable music players and other items and the average consumer has several of these items. However, many of these items require alternating current. Inverters are well known to those of ordinary skill in the art and are used to convert direct current, such as from a conventional battery, to alternating current, such as required by many consumer electronics. Various electrical outlets having an inverter include multiple sockets. However, there remains a need for an electrical outlet having rotary sockets and adjustable to a desired angle of rotation.

SUMMARY

According to an embodiment of the present invention, an electrical outlet comprises: an outlet housing having an outer support arm and an inner support arm, the outer and inner support arms defining a socket receptacle; the inner and outer support arms having a rotational support member and a fixed electrical contact assembly; a rotary socket having at least one plug receiver for receiving an electrical plug and a rotary contact plate attached thereto; wherein the rotary contact plate is rotationally supported by the rotational support member, and the rotary contact plate maintains electrical contact with the fixed electrical contact assembly through a predetermined range of rotation of the rotary socket.

According to another embodiment, an adjustable rotary socket assembly comprises: a housing having a fixed electrical contact assembly and an upwardly urged detent; a socket having a first side, a second side, a rotary contact plate affixed to each side thereof, and an upper casing having at least one plug receiver; the plug receiver having at least one terminal contact; the rotary contact plates are electrically connected to the at least terminal contact and the fixed electrical contact assembly; wherein the rotary contact plates are rotationally supported by the housing, limit a range of rotation of the rotary socket, and have at least one indent; and wherein the detent is received by the at least one indent at an angle of rotation within the range of rotation of the rotary socket.

Further aspects, objectives, and advantages, as well as the structure and function of embodiments, will become apparent from a consideration of the description, drawings, and examples.

BRIEF DESCRIPTION OF THE DRAWINGS

The features and advantages of the invention will be apparent from the following drawings wherein like reference numbers generally indicate identical, functionally similar, and/or structurally similar elements.

DETAILED DESCRIPTION

Embodiments of the invention are discussed in detail below. In describing embodiments, specific terminology is employed for the sake of clarity. However, the invention is not intended to be limited to the specific terminology so selected. A person skilled in the relevant art will recognize that other equivalent parts can be employed and other methods developed without departing from the spirit and scope of the invention.

Figure 1:
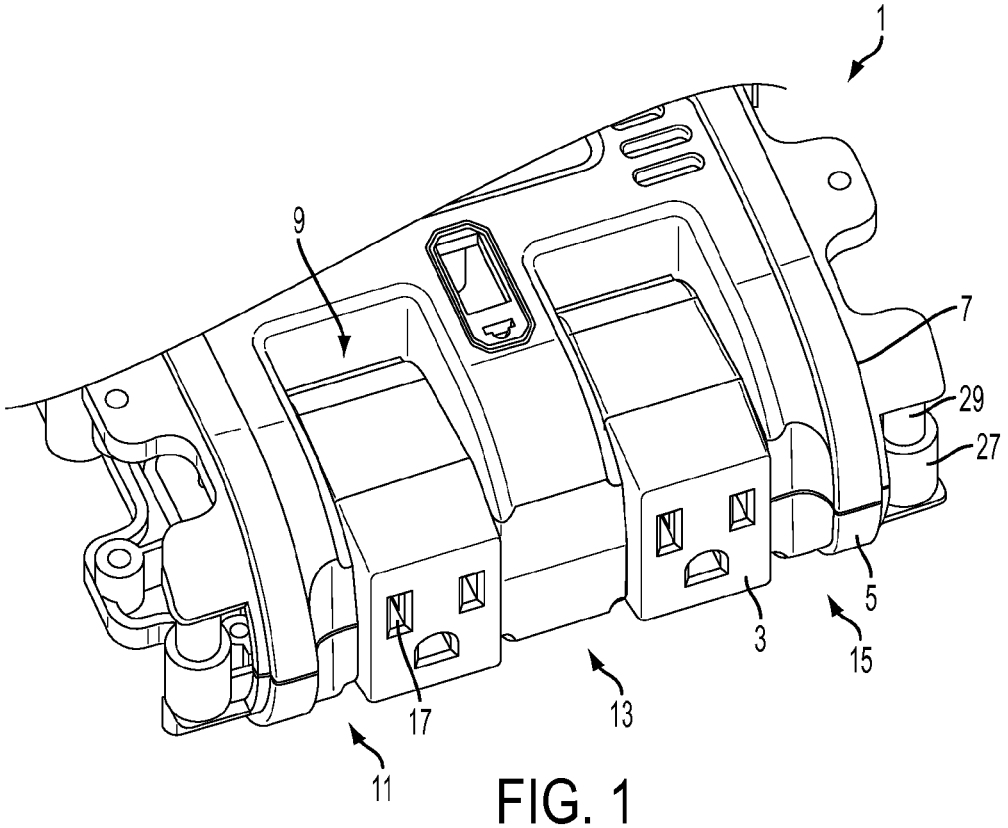
FIG. 1 is a perspective view of a rotary socket assembly according to an embodiment of the invention.
Figure 7:
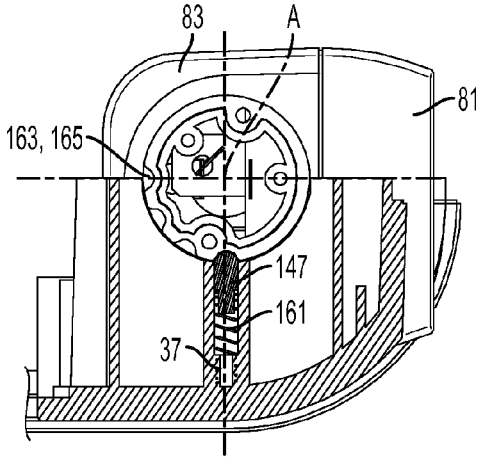
FIG. 7 is a partial cross-sectional view of the rotary socket assembled with upper and lower housing assembly.

Referring now to FIG. 1, there is shown an embodiment of a rotary socket assembly 1 which generally comprises rotary sockets 3, a lower housing 5 and an upper housing 7. The lower and upper housings 5, 7 form rotary socket receptacles 9 between support members 11, 13, and 15. The rotary socket assembly 1 may be integrated with a battery housing, a DC-to-AC inverter, or other type of circuit board (not shown) for connecting to a power source (not shown). According to the embodiment of the present invention shown on FIG. 1, a partial view of the inverter is shown in combination with the rotary socket assembly 1. As shown, the inverter assembly may be integral with the rotary socket assembly. Alternatively, the rotary socket assembly 1 may be separate from the inverter assembly. The rotary sockets 3 have at least one plug receiver 17 for receiving an electrical plug (not shown). As known to one having ordinary skill in the art, the plug may include receivers for live, neutral, and/or ground connections. The rotary sockets 3 rotate within the rotary socket assembly 1 about a rotational axis A, as shown in FIG. 7. It is foreseen that the assembly may be modified to include only one rotary socket or more than two rotary sockets.

Figure 2:
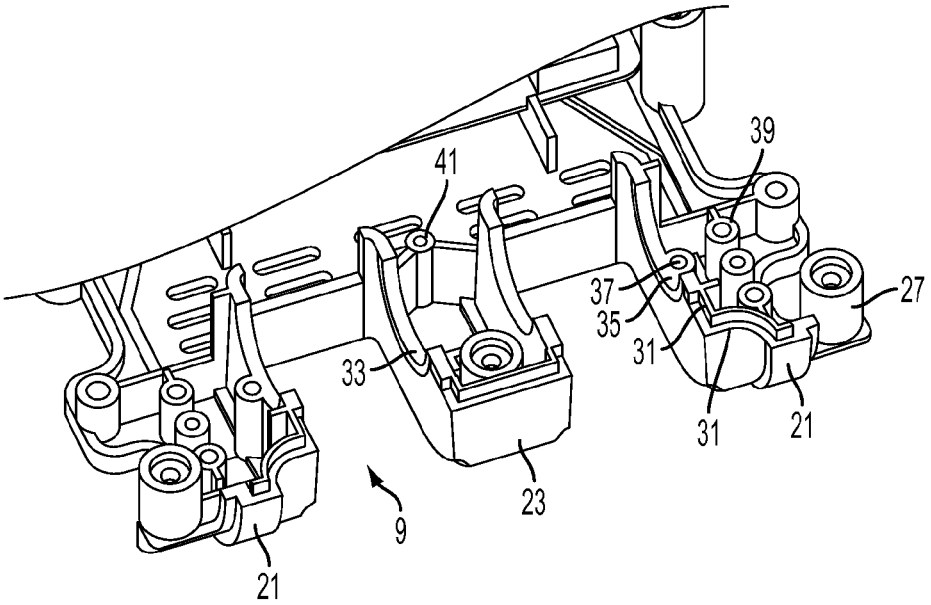
FIG. 2 is a perspective view of the lower housing of the rotary socket assembly of FIG. 1.

Referring now to FIGS. 1 and 2, the lower housing 5 is shown. The lower housing 5 generally comprises support arms 21 and 23 for rotatably supporting the rotary sockets 3. Each outer support arm 21 forms a socket receptacle 9 with the middle support arm 23. According to an embodiment of the present invention, the outer support arms 21 are substantially identical but in mirror image. The lower housing 5 is formed with female connectors 27 for receiving male connectors 29 of the upper housing 7, as shown in FIG. 1. Advantageously, the male/female connectors properly align the lower and upper housings 5, 7 to facilitate rotation of the rotary sockets 3. Additionally, the lower housing 5 includes alignment means 31 such as a groove and lip for further aligning and securing together the lower and upper housings 5, 7. It is foreseen that other methods may be used to align the lower and upper housings such as, for example, a tongue and groove connection.

Figure 3:
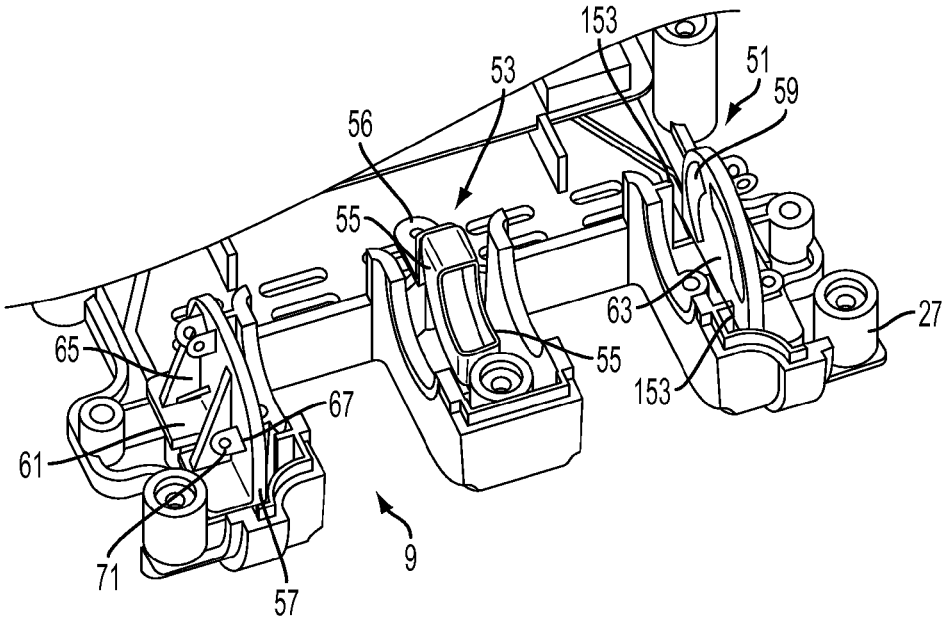
FIG. 3 is a perspective view of the fixed electrical contacts assembled with the lower housing of the rotary socket assembly of FIG. 1.

The lower housing 5 further includes rotational support members 33, 35. The middle support arm 23 forms an inner rotational support member 33 for each socket receptacle 9. The inner rotational support members 33 are semi-circular, substantially semi-circular, or partially circular in profile in order to facilitate rotation of the rotary sockets 3. The outer support arms 21 each form outer rotational support members 35. Similar to the inner rotational support members 33, the outer rotational support members 35 are semi-circular, substantially semi-circular, or partially circular in profile in order to facilitate rotation of the rotary sockets 3. A detent receiver 37 is formed in the surface of the outer rotational support members 35 and extends outwardly therefrom, as shown in FIGS. 2 and 3. Additionally, structural supports 39 and 41 are formed in the lower housing 5.

Referring now to FIG. 3, fixed electrical contact assemblies 51 and 53 are shown assembled with the lower housing 5. The middle fixed electrical contact assembly 53 is supported by middle structural supports 41 on support member 23, shown in FIG. 2. The middle fixed electrical contact assembly 53 comprises two electrical contact plates 55 and a connection eyelet 56. According to an embodiment of the present invention, the electrical contact plates 55 may be arcuate in profile in order to mate with electrical contacts of the rotary sockets 3 over a range of rotation, as explained in more detail below. As illustrated in FIG. 3, the middle fixed electrical contact assembly 53 provides an electrical contact plate 55 facing both receptacles 9, for connection with respective rotary sockets 3. This configuration, for example, allows for each rotary socket to share a common ground.

The outer fixed electrical contact assemblies 51 comprise fixed support structure 57 and electrical contact plates 59. The fixed support structures 57 comprise a base 61 and face plate 63. The base 61 of the fixed support structures 57 are supported on outer structural supports 39 on outer support members 21 of the lower housing 5. According to an embodiment of the present invention, reinforcement webs 65 are provided between the base 61 and face plate 63 to generally provide structural support and, more particularly, to provide structural support against outwardly acting forces, such as, for example, by rotary sockets 3. According to an embodiment of the present invention, the reinforcement webs 65 maintain the base 61 and face plate 63 at a generally perpendicular angle relative to each other.

The face plates 63 include slots 67 for receiving eyelets 71 of the electrical contact plates 59 therethrough. According to one embodiment of the present invention, the face plates 63 have four slots 67 corresponding to the electrical contact plates 59 having two eyelets 71 each. According to other embodiments of the present invention, the face plate 63 may include more or fewer slots 67 depending on the type of electrical contact plate or number of electrical contact plates needed for each rotary socket 3. Upon assembly with the lower housing 5, the eyelets 71 of the contact plates 59 are connected to a printed circuit board (PCB) or other electronic device (not shown) with wires or other methods as known to a person having ordinary skill in the art. The PCB or other electronic device, such as, for example, an inverter, may be integrated with the rotary socket assembly 1.

According to an embodiment of the present invention, the electrical contact plates 59 may be arcuate in profile in order to mate with electrical contacts of the rotary sockets 3 over a range of rotation, as explained in more detail below.

Figure 4:
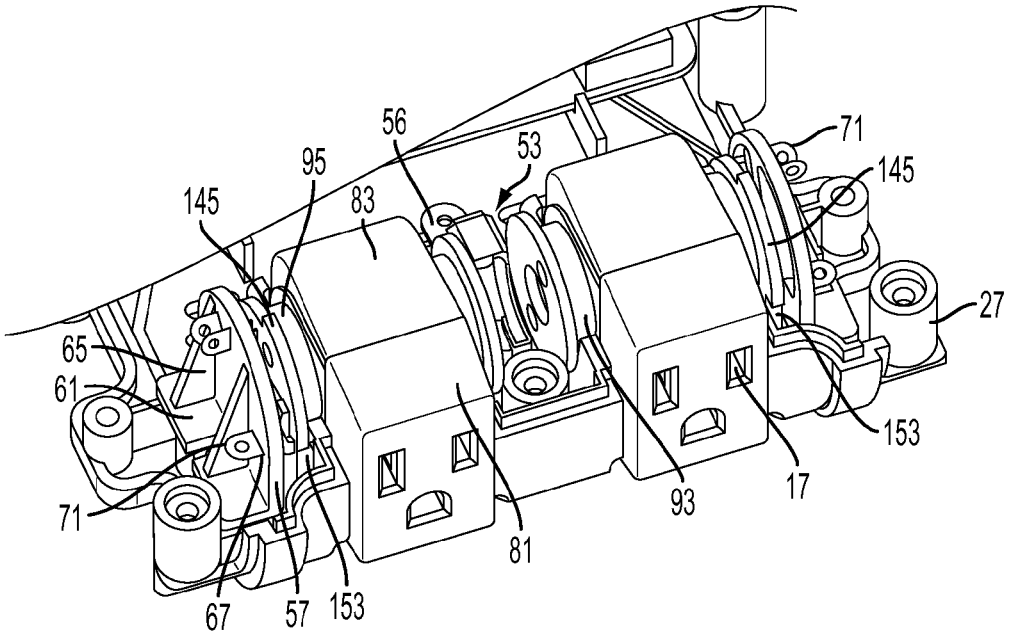
FIG. 4 is a perspective view of the rotary sockets assembled in the assembly of FIG. 3.

FIG. 4 shows the rotary sockets 3 installed in the lower housing assembly of FIG. 3. The rotary sockets 3 are supported by the inner and outer rotational support members 33 and 35.

Figure 5:
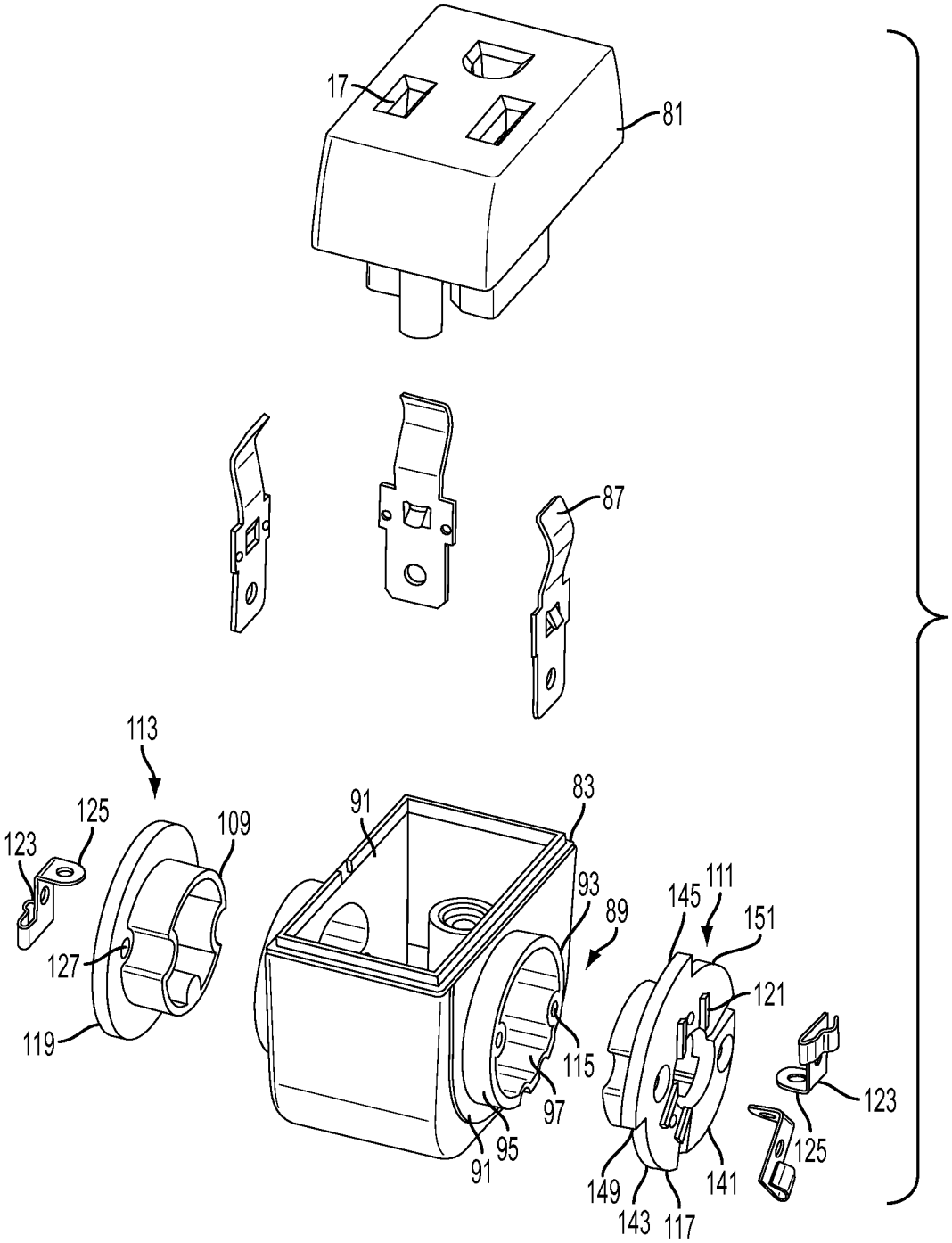
FIG. 5 is an exploded view of the rotary sockets.

Now referring to FIG. 5, the rotary socket 3 is described in more detail. The rotary socket 3 comprises an upper socket casing 81 and a lower socket casing 83. The upper socket casing 81 includes at least one socket opening 17 for receiving male contacts of an electrical plug (not shown). As known to one of ordinary skill in the art, the socket openings 17 generally include contacts for live, neutral, and/or ground. Terminal plates 87 are received in and form the live, neutral, and/or ground contacts of the socket openings 17. Upon assembly of the socket body 3 as shown in FIG. 4, the terminal plates 87 extend downwardly into the lower socket casing 83. Terminal openings 89 are formed through sidewalls 91 of the lower socket casing 83. Rotational support members 93 having a circular or substantially circular outer surface 95 extend outwardly from the sidewalls of the lower socket casing at the perimeter of the terminal openings 89. The inner surfaces 97 of the rotational support members 93, shown in FIG. 5, are generally non-circular and receive male portions 109 of the first and second rotary contact plates 111, 113, respectively, to prevent relative rotation therebetween. According to an embodiment of the present invention, the inner surface 97 of the rotational support member 93 includes substantially circular segments interrupted by hole portions 115 formed on the inner surface 97 thereof. The male portions 109 of the first and second rotary contact plates 111, 113 are formed to generally match the contour of the inner surface 97 of the rotational support member 93 and to fit therein thereby preventing relative rotation therebetween. It is foreseen that other methods may be used to prevent relative rotation between the surfaces such as, for example, with adhesives.

The first and second rotary contact plates 111 and 113 comprise the male portions 109, as described above, and contact plate portions 117, 119, respectively. According to an embodiment of the present invention, the contact plate portion 119 of the second rotary contact plate 113 is circular or substantially circular. A receptacle 121 is formed on contact plate portion 117, and a similar receptacle (not shown) is formed on contact plate portion 119, for affixing a rotary contact 123 thereto. An eyelet 125 of the rotary contact 123 extends inwardly through an opening in the second rotary contact plate 113 and the terminal opening 89. Similarly, two receptacles are formed on the contact plate portion 117 of the first rotary contact plate 111 for affixing two rotary contacts thereto. Eyelets 125 of the rotary contacts 123 extend inwardly through an opening in the first rotary contact plate 111 and the terminal opening 89. Each eyelet 125 of the respective rotary contacts 123 are electrically connected to a respective terminal plate 87 according to live, neutral, or ground. The electrical connection between the rotary contacts 123 and terminal plates 87 may be made by methods well known to one of ordinary skill in the art such as, for example, through wire connection or plate-to-plate contact.

Figure 6:
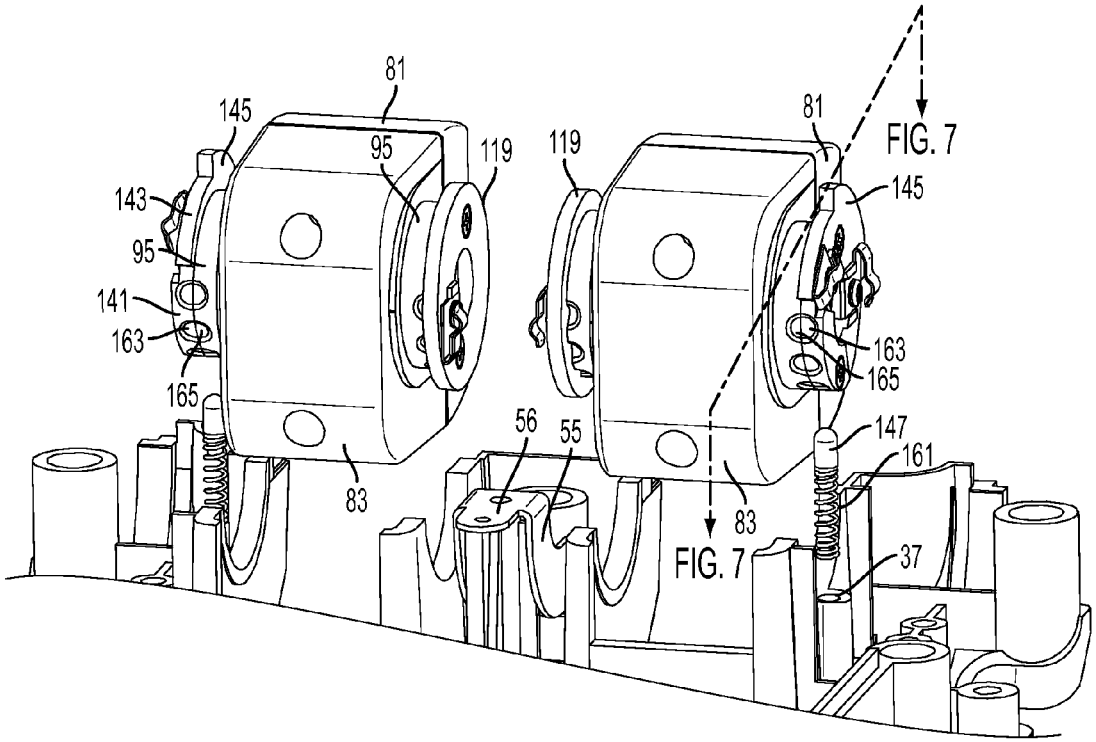
FIG. 6 is a rear exploded view of rotary sockets and lower housing of the rotary socket assembly.

The first and second rotary contact plates 111 and 113 further include securing means for securing the rotary contact plates 111 and 113 to the lower socket casing 83. As shown in FIG. 5, holes 127 are formed through the rotary contact plate portions 117 and 119. When the first and second rotary contact plates 111 and 113 are assembled with the lower socket casing 83, as shown in FIGS. 1, 4, and 6, the holes 127 of the rotary contact plate portions 117 and 119 align with hole portions 115 of the rotational support member 93. The holes 127 and hole portions 115 may be threaded in order to receive a threaded connector (not shown) to secure the first and second rotary contact plates 111 and 113 to lower socket casing 83. Alternatively, the first and second rotary contact plates 111 and 113 may be secured to lower socket casing 83 by other ways known to one of ordinary skill in the art, such as, for example, an interference fit.

Referring again to FIG. 4, upon assembly of the rotary socket 3 in to the lower housing 4, the rotary contacts 123 contact the middle contact face 55 and outer fixed electrical contact plates 59. As the rotary socket 3 rotates, direct contact between the rotary contacts 123 and the fixed contact faces 55 and the fixed contact plates 59 is maintained because of the arcuate shape of the fixed contact faces 55 and fixed contact plates 59.

Referring now to FIGS. 5, 6, and 7, the first rotary contact plate 111 includes features to control rotation of the rotary socket 3. As shown in FIGS. 5 and 6, first rotary contact plate portion 117 includes a first radius portion 141, a second radius portion 143, and a third radius portion 145. According to an embodiment of the present invention, the radius of each respective portion may be different. The first radius portion 141 is sized to accommodate an upwardly biased detent 147 and otherwise not obstruct rotation of the rotary socket 3 notwithstanding the detent for adjusting the rotary socket to a desired position. For example, no portion of the first radius portion 141 obstructs rotation of the rotary socket relative to the lower housing 5. According to an embodiment of the present invention, the radius of the first radius portion 141 may be equal to or less than the radius of the rotational support member 35. The interface between the detent 147 and the first radius portion 141 will be described in more detail below. According to an embodiment of the present invention, the radius of the second radius portion 143 may be equal to or greater than the radius of the first radius portion 141. The radius of the third radius portion 145 is greater than the radius of the first and second radius portions 141 and 143 and greater than the radius of the rotational support member 35. As shown in FIG. 5, the arc of the third radius portion 145 is defined by a first end 149 and a second end 151 where the arc of the third radius portion 145 is discontinuous with the arc of the second radius portion 143. According to an embodiment of the present invention, the arc of the third radius portion 145 spans approximately 90 degrees but may vary depending on the desired range of rotation, such as approximately less than or equal to 180 degrees or greater than 0 degrees, as explained in greater detail below.

Upon assembly of the rotary socket 3 into the lower housing 5, the third radius portion 145 is rotated away from the outer rotational support member 35 such that the third radius portion 145 is in an upward position facing away from the lower housing 5 and the first radius portion 141 is in a downward position facing towards the lower housing 5. As shown in FIG. 4, as the rotary socket 3 is rotated, one of the first or second stops 149, 151 will abut a stop edge 153 of the lower housing 5. Similarly, as the rotary socket 3 is rotated in the opposite direction, the other of the first or second stops 149, 151 will abut the other stop edge 153 of the lower housing 5. In this manner, the range of rotation of the rotary socket 3 is limited. It is foreseen that the range of the rotation may be adjusted by varying the arc of the third radius portion 145 to span either greater or less than 90 degrees, such as, for example less than or equal to 180 degrees or greater than 0 degrees. Preferably, the range of rotation is between 75 degrees and 105 degrees. Even more preferably, the range of rotation is approximately 90 degrees. Although the first, second, and third radius portions are shown only on the first rotary contact plate 111, it is foreseen that the second rotary contact plate may be modified to include these features, as well.

Within the range of rotation, as explained above, discreet degrees of rotation of the rotary socket 3 may be desired. According to an embodiment of the present invention shown in FIGS. 6 and 7, a detent 147 is provided to fix the rotary socket 3 at a desired angle of rotation. As shown in FIG. 6, the detent receiver 37 receives the detent 147 with an upwardly urging spring bias 161. The first rotary contact plate portion 117 and the outer surface of the rotational support members 95 form mating partial-circular indents 163, 165. According to an embodiment of the present invention, the indents 163, 165 are both semi-circular so as to evenly distribute loading of the detent between the rotary contact plate portion 117 and the outer surface of the rotational support members 95. The mating indents 163, 165 form a circular indent for receiving the upwardly biased detent 147 when the rotary socket 3 is assembled with the lower housing 5. As shown in FIG. 7, the installed rotary socket 3 is shown in partial cross-section. According to an embodiment of the present invention, the indents 163, 165 of the rotary contact plate portion 117 and the outer surface of the rotational support member 95 may be formed at 30 degree angles relative to each other and within the range of rotation as defined by the arc of the third radius portion. According to an embodiment of the present invention, an indent 163, 165 may be formed directly opposite one or each of the first or second stops 149, 151.

As shown in FIG. 7, four indents 163, 165 are formed at 30 degree angles within a 90 degree range of rotation. It is foreseen that more than or less than four indents may be formed. It is further foreseen that the indents may be formed along any of the ranges of rotation explained above. As a user rotates the rotary socket 3, the detent 147 will snap into the downwardly facing indent 163, 165 to hold the rotary socket 3 at the desired angle. When the user desires to further rotate the rotary socket 3, applied rotational force to the rotary socket 3 will cause the angular surface of the indent 163, 165 to push the detent 147 into the detent receiver 37. As rotation of the rotary socket 3 continues, another indent 163, 165 will rotate to face the detent 147 and the detent 147 will snap into the newly downwardly facing indent 163, 165.

Although the detent is shown only with respect to the first rotary contact plate 111, it is foreseen that the second rotary contact plate and associated lower housing may be modified to include these features, as well.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

I claim:

1. An electrical outlet comprising:

an outlet housing having two outer support arms and an inner support arm spaced between the two outer support arms to define two socket receptacles;

the inner and outer support arms each having a rotational support member formed therein, wherein the two outer support arms each have rotational support members, and the inner support arm has rotational support members on two sides thereof;

electrical contact assemblies comprising electrical plates fixed to the inner and outer support arms, respectively;

two rotary sockets each having at least one plug receiver for receiving an electrical plug and being disposed, respectively, in the two socket receptacles, each rotary socket having opposite outer sides;

rotary contact plates attached to the opposite outer sides, respectively, of each rotary socket; and at least one electrical contact disposed on each of the rotary contact plates;

wherein the rotary contact plates are rotationally supported by the rotational support members, respectively, and the rotary contact plates each maintain electrical connection between the at least one electrical contact thereon and the respective electrical plate through a predetermined range of rotation of the respective rotary sockets, wherein the electrical contact assembly fixed to the inner support arm comprises two electrical contact plates facing in opposite directions toward a respective one of the two rotary sockets and are in electrical contact with each other and with the respective rotary socket to provide a common path to a ground connection for the two rotary sockets.

2. The electrical outlet of claim 1, wherein the inner and outer arms are configured to present the rotational support members as fixed rotational support members.

3. The electrical outlet of claim 1, wherein the range of rotation of each rotary socket is less than or equal to 180 degrees.

4. The electrical outlet of claim 1, wherein at least one rotary contact plate on each rotary socket further comprises a stop portion having a radius larger than a radius of the rotational support member.

5. The electrical outlet of claim 4, wherein the stop portion comprises a first end and a second end, and the predetermined range of rotation of each rotary socket is determined by the first and second ends of the stop portion.

6. The electrical outlet of claim 1, in combination with an inverter.

7. The electrical outlet according to claim 1, wherein the housing further includes an upwardly urged detent;

wherein each rotary contact plates limit a range of rotation of the rotary socket, and have at least one indent; and wherein the detent is received by the at least one indent at an angle of rotation within the range of rotation of each rotary socket.

8. The electrical outlet of claim 7, wherein each rotary contact plate further comprises:

a first radius portion having a radius less than or equal to a mating radius of the housing, and having the at least one indent;

a second radius portion having a radius equal to or greater than the radius of the first radius portion; and a third radius portion having a radius greater than the radius of the first and second radius portions and greater than the mating radius of the housing.

9. The electrical outlet of claim 8, wherein the third radius portion has a first end and a second end, wherein the first and second ends define the range of rotation of each rotary socket.

10. The electrical outlet of claim 9, wherein upon rotation of each rotary socket in a first direction, the first end abuts the housing and stops rotation of each rotary socket in the first direction, and wherein upon rotation of each rotary socket in a second direction, the second end abuts the housing and stops rotation of each rotary socket in the second direction.

11. The electrical outlet of claim 9, wherein the at least one indent is a plurality of indents.

12. The electrical outlet of claim 11, wherein the plurality of indents are angularly spaced from each other within an arc of less than or equal to 180 degrees.

13. The electrical outlet of claim 9, wherein the first and second ends are at about less than or equal to 180 degrees from each other.

* * * * *